US006732626B2

(12) United States Patent
Hong

(10) Patent No.: US 6,732,626 B2
(45) Date of Patent: May 11, 2004

(54) TAPE-CUTTING DEVICE OF AUTOMATIC ROLL TAPE CUTTER

(76) Inventor: Myon Ki Hong, # 602, Greenhillvillat Villa, 198-36, Mia 3-Dong, Gangbuk-Gu, Seoul (KR)

( * ) Notice: Subject to any disclaimer, the term of this patent is extended or adjusted under 35 U.S.C. 154(b) by 0 days.

(21) Appl. No.: 10/370,705

(22) Filed: Feb. 24, 2003

(65) Prior Publication Data

US 2003/0230181 A1 Dec. 18, 2003

(30) Foreign Application Priority Data

Jun. 18, 2002 (KR) ..... 10-2002-0034161

(51) Int. Cl.[7] ..... B26D 7/08

(52) U.S. Cl. ..... 83/649; 83/168; 83/922; 83/949; 221/30; 225/95

(58) Field of Search ..... 83/168, 169, 695, 83/654, 922, 949, 147, 397, 358, 859, 860, 649; 225/33, 95; 221/30, 31, 32

(56) References Cited

U.S. PATENT DOCUMENTS 2,290,223 A * 7/1942 Black et al. ..... 83/397
5,211,093 A * 5/1993 Horniak ..... 83/426
5,487,544 A * 1/1996 Clapper, Jr. ..... 463/16
5,685,211 A * 11/1997 Lax ..... 83/224
5,725,719 A * 3/1998 Szczepaniec et al. ..... 156/353
5,922,169 A * 7/1999 Chodacki et al. ..... 156/521
5,938,889 A * 8/1999 Hirano et al. ..... 156/540
6,145,561 A * 11/2000 Watanabe et al. ..... 156/517
6,189,428 B1 * 2/2001 Hoshino ..... 83/147
6,386,415 B1 * 5/2002 Tsai ..... 225/11

* cited by examiner

*Primary Examiner*—Allan N. Shoap
*Assistant Examiner*—Phong Nguyen
(74) *Attorney, Agent, or Firm*—Birch, Stewart, Kolasch & Birch, LLP

(57) ABSTRACT

Disclosed is a tape cutting device of an automatic roll tape cutter capable of automatically cutting a tape fed out by a proper length. The tape cutting device includes: a frame detachably assembled onto the front surface of a case of the tape cutter, and having a slot formed therethrough and movable blade guide channels formed on both sides of the rear surface thereof; a fixed blade mounted on the upper portion of the rear surface of the frame; a movable blade mounted on the lower portion of the rear surface of the frame in such a manner as to be parallel with the fixed blade, and having a horizontal hole formed on one side of the lower end thereof, an inclined hole formed on the other side of the lower end thereof, and a sensor inserting hole formed at the center thereof; and a lubricating oil supply part for supplying lubricating oil to sides of the blades or a side of the fixed blade or the movable blade.

4 Claims, 5 Drawing Sheets

[fig.1]
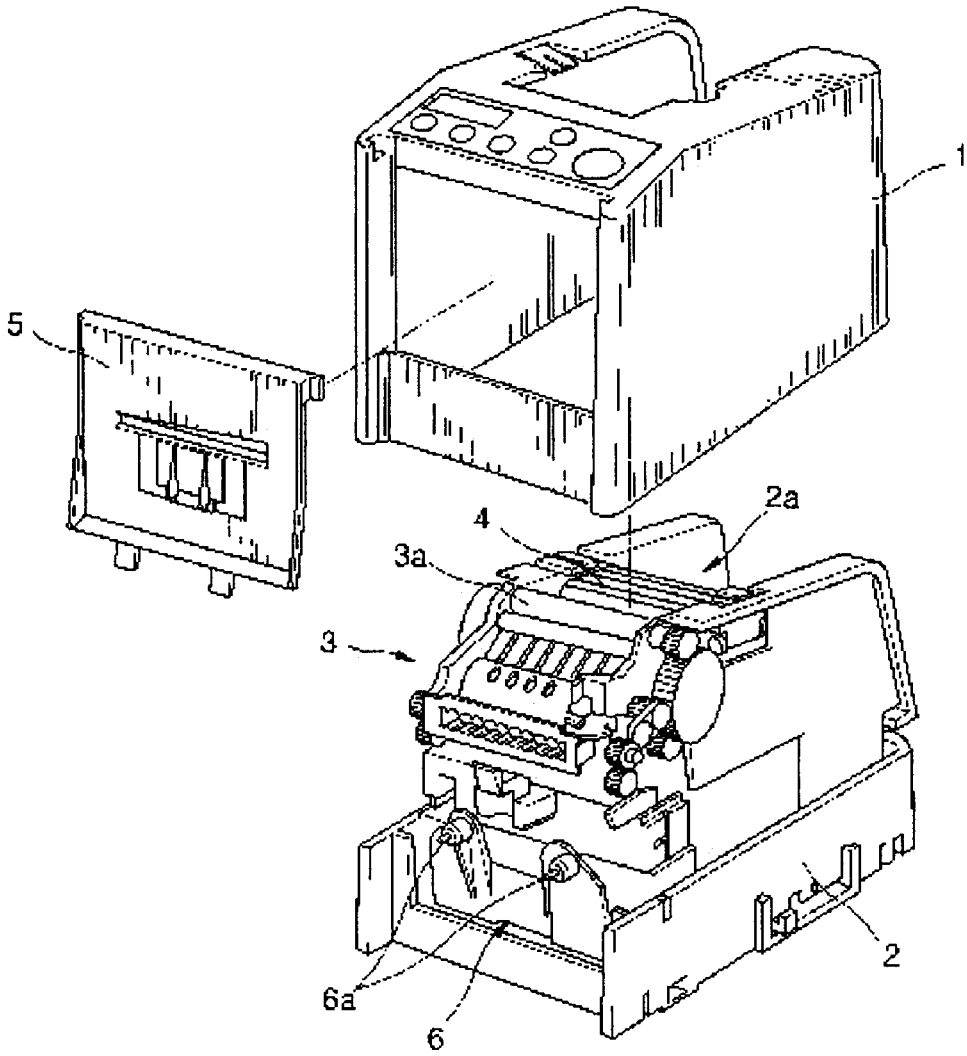

[fig.2]
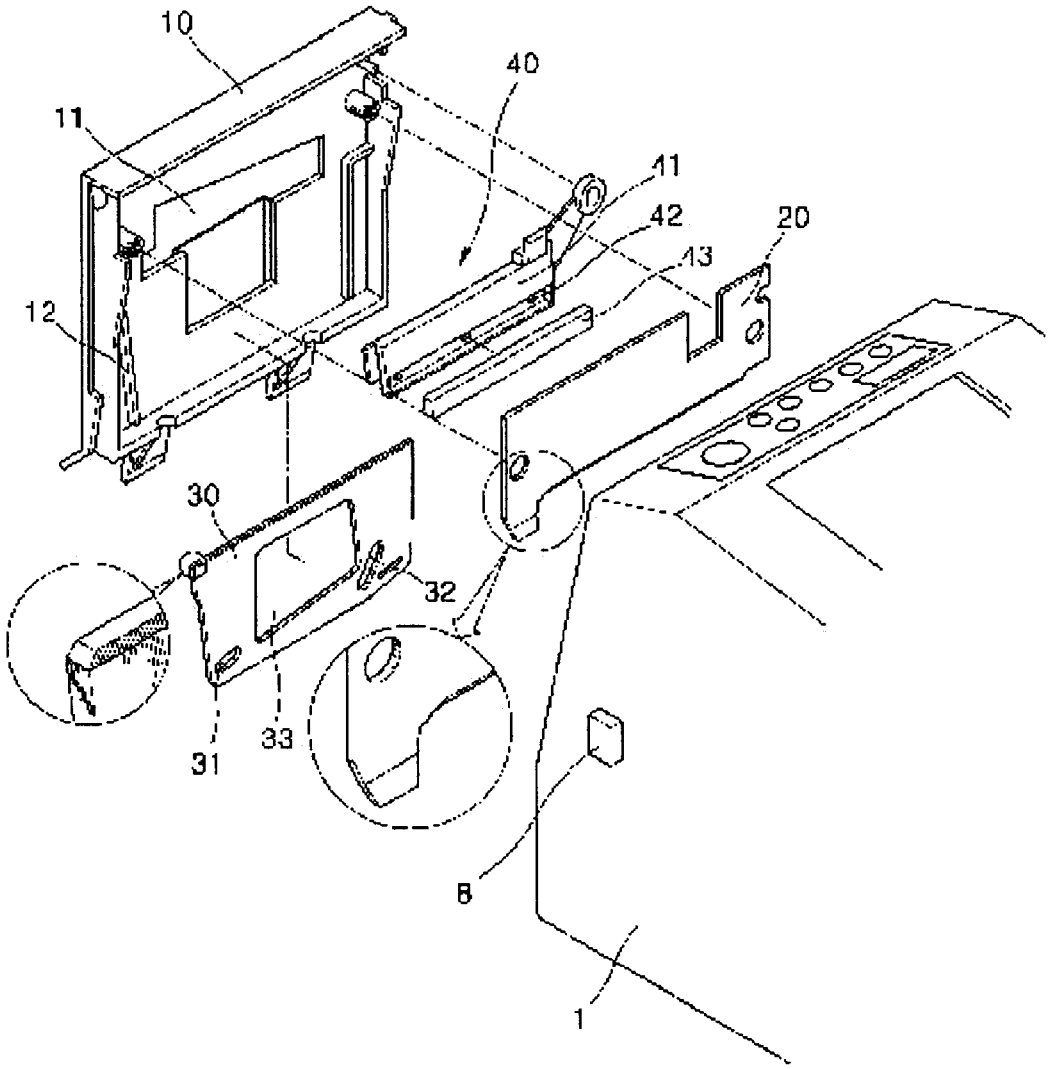

[fig.3]
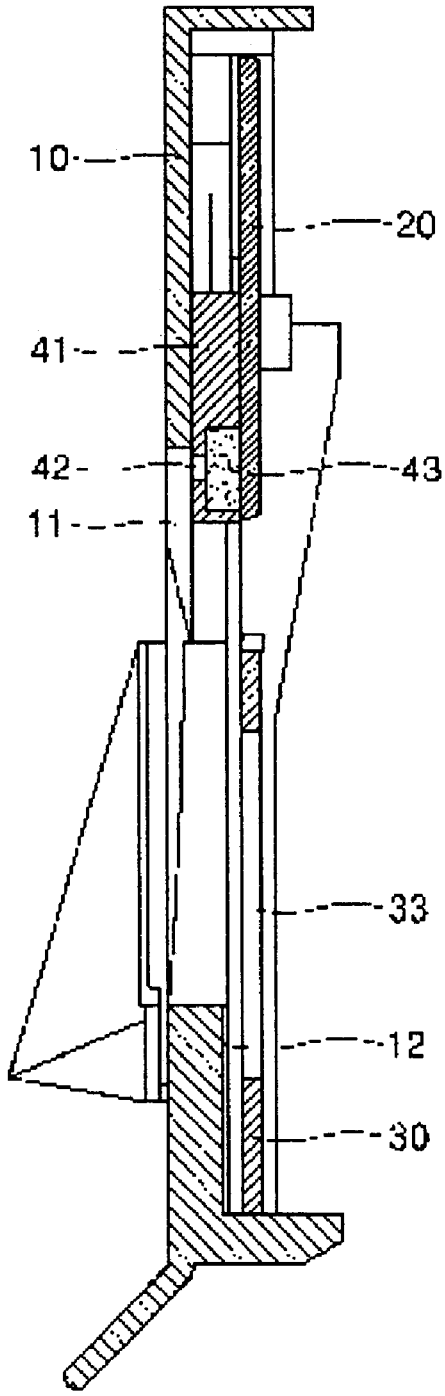

[fig.4]
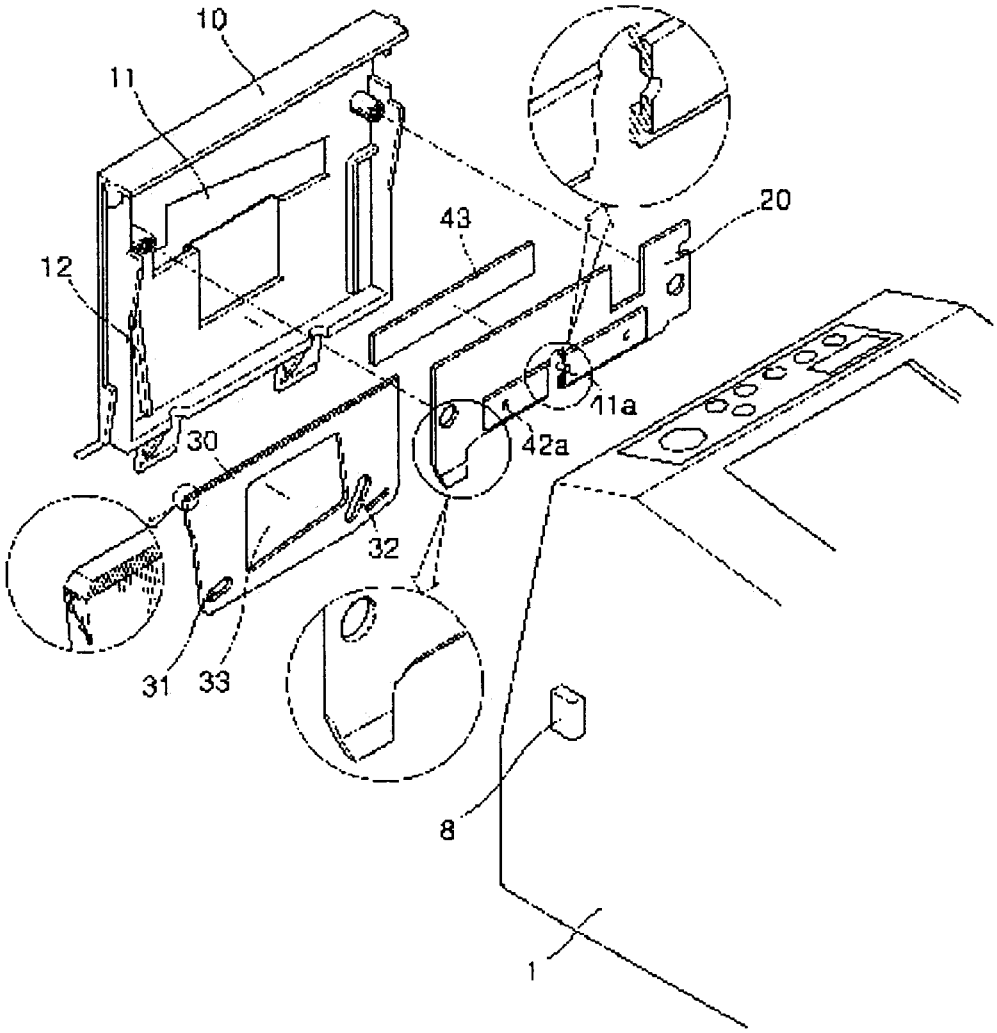

[fig.5]
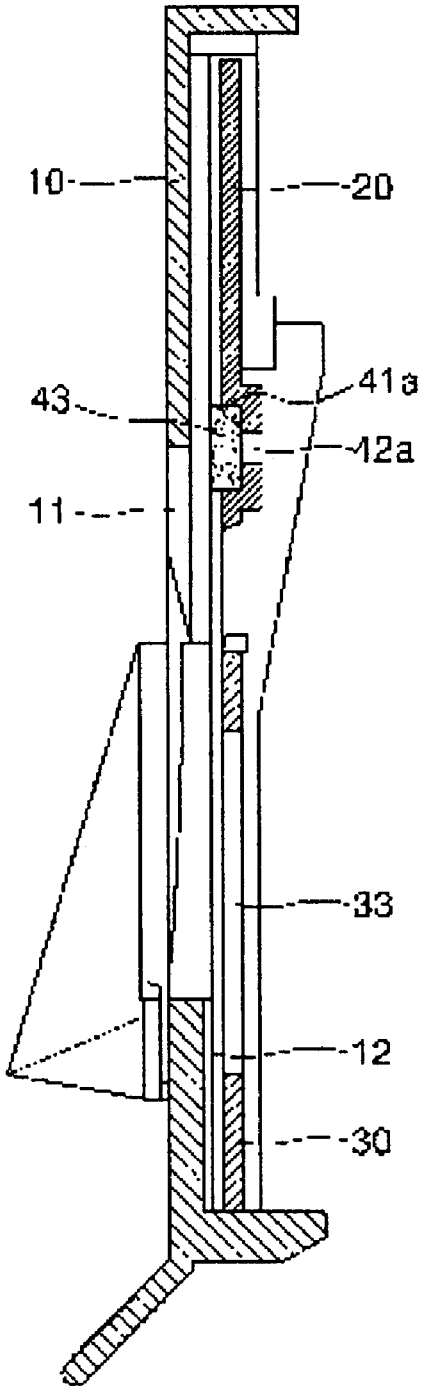

TAPE-CUTTING DEVICE OF AUTOMATIC ROLL TAPE CUTTER

This nonprovisional application claims priority under 35 U.S.C. § 119(a) on Patent Application No. 2002-34161 filed in KOREA on Jun. 18, 2002, which is herein incorporated by reference.

BACKGROUND OF THE INVENTION

1. Field of the Invention

The present invention relates to a tape cutting device of an automatic roll tape cutter, and more particularly, to a tape cutting device of an automatic roll tape cutter, which can automatically and exactly cut a tape after the tape is fed out from a main body by a proper length.

2. Background of the Related Art

In general, band-type adhesive tapes are mainly used in companies, department stores, large-scale discount stores, and other places for adhering wrapping paper when people wrap sold products.

An automatic roll tape cutter, in which a large roll type tape is enclosed for efficient and fast work, and, which feeds out the large roll type tape by a desired length and automatically cuts the tape, has been invented and widely used.

As shown in FIG. 1, such an automatic roll tape cutter includes upper and lower cases 1 and 2, a tape feeder 3 mounted inside the cases 1 and 2 for feeding the tape out by means of a number of rollers interlocking with a driving device, a tape guider 4 located between a tape holding part (not shown) and a roller 3*a* inside the tape feeder 3 for guiding the roll tape to prevent the folding of the tape when the roll tape is fed out, and a tape cutter 5 mounted in front of the upper case 1 in such a manner as to be opened and closed for cutting the tape.

A tape cutting device of the tape cutter has a fixed blade and a movable blade engaged with each other for cutting the tape, as in a typical shearing machine, not shown in the drawings, for cutting paper or laminated sheets. The movable blade is inclined at a proper angle to minimize load at the time of cutting the tape and to easily cut the tape, and cuts the tape continuously from a side of the tape while rising and falling relative to the fixed blade.

However, the conventional tape cutting device has several disadvantages in that the blade cannot work smoothly because an adhesive of the tape is adhered to the blade, and that it is inconvenient to feed lubricating oil using an additional tool to operate the fixed blade and the movable blade smoothly.

Furthermore, the conventional tape cutting device has another disadvantage in that it is impossible to cut the tape of a short length because an interval between the blade and a sensor which senses the existence of the tape and controls the operation of the cutter.

SUMMARY OF THE INVENTION

Accordingly, the present invention is directed to a tape cutting device of an automatic roll tape cutter that substantially obviates one or more problems due to limitations and disadvantages of the related art.

An object of the present invention is to provide a tape cutting device of an automatic roll tape cutter, which has a lubricating oil supply part for supplying lubricating oil to both sides or one side of a movable blade and a fixed blade which cuts a tape by a predetermined length, thereby making the movable blade and the fixed blade work smoothly without an adhesive of the tape adhered to the blades.

Another object of the present invention is to provide a tape cutting device of an automatic roll tape cutter, which can exactly cut the tape without an adhesive of the tape adhered to the blades by making cutting sections of the movable blade and the fixed blade protruding inwardly.

A further object of the present invention is to provide a tape cutting device of an automatic roll tape cutter, which can minimize a size of the automatic roll tape cutter and cut the tape of a short length by forming a sensor inserting hole at the center of the movable blade for inserting a sensor for sensing the tape.

A still further object of the present invention is to provide a tape cutting device of an automatic roll tape cutter, which can make users work safely by preventing the user's finger from being put into an interval between the movable blade and the fixed blade because the interval between the movable blade and the fixed blade is narrow.

To achieve these objects and other advantages and in accordance with the purpose of the invention, as embodied and broadly described herein, a tape cutting device of an automatic roll tape cutter, which feeds out a roll tape mounted in the roll tape cutter by a predetermined length and cuts the tape automatically, includes: a frame detachably assembled onto the front surface of a case of the tape cutter, the frame having a slot formed therethrough and movable blade guide channels formed on both sides of the rear surface thereof; a fixed blade mounted on the upper portion of the rear surface of the frame; a movable blade mounted on the lower portion of the rear surface of the frame in such a manner as to be parallel with the fixed blade for rising and falling, the movable blade having a horizontal hole formed on one side of the lower end thereof, an inclined hole formed on the other side of the lower end thereof, and a sensor inserting hole formed at the center thereof; and a lubricating oil supply part for supplying lubricating oil to sides of the fixed blade and the movable blade or a side of the fixed blade or the movable blade.

Cutting sections of the fixed blade and the movable blade protrude inwardly to exactly cut the tape without an adhesive of the tape adhered to the blades.

The lubricating oil supply part has a lubricating oil storing member being in contact with one side of the fixed blade and having a sponge soaked with lubricating oil on the lowr portion thereof, and a lubricating oil supply hole formed in the lubricating oil storing member for supplying lubricating oil to the sponge.

The lubricating oil supply part has a groove formed in the fixed blade or the movable blade for allowing the sponge to be embedded therein and an oiling hole formed in the fixed blade or the movable bladed for supplying lubricating oil to the sponge.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a divided perspective view of a conventional tape cutter;

FIG. 2 is an exploded perspective view of a tape cutting device according to a first preferred embodiment of the present invention;

FIG. 3 is a sectional view of the tape cutting device according to the present invention;

FIG. 4 is an exploded perspective view of a tape cutting device according to a second preferred embodiment of the present invention; and FIG. 5 is a sectional view of the tape cutting device according to the second preferred embodiment of the present invention.

DETAILED DESCRIPTION OF THE PREFERRED EMBODIMENT

Reference will now be made in detail to the preferred embodiments of the present invention, examples of which are illustrated in the accompanying drawings.

FIG. 2 is an exploded perspective view of a tape cutting device according to a first preferred embodiment of the present invention, and FIG. 3 is a sectional view of the tape cutting device according to the present invention.

As shown in the drawings, the tape cutting device includes a frame 10 detachably assembled onto the front surface of a case of an automatic roll tape cutter, which feeds out a roll tape mounted in the case by a predetermined length and automatically cut the roll tape. The frame 10 includes a slot 11 formed therethrough for feeding the tape out and movable blade guide channels 12 formed on both sides of the rear surface thereof for guiding a movable blade which cuts the tape.

A fixed blade 20 is mounted on the upper portion of the rear surface of the frame 10 for cutting the tape, and the movable blade 30 is mounted on the lower portion of the rear surface of the frame 10 in such a manner as to be parallel with the fixed blade 20 for cutting the tape while moving along the movable blade guide channels 12. The movable blade 30 includes a horizontal hole 31 formed on one side of the lower end thereof, an inclined hole 32 formed on the other side of the lower end thereof, and a sensor inserting hole 33 formed at the center thereof for inserting a tape feed-out sensor 8 thereinto. The tape feed-out sensor 8 outwardly protrudes from the case for sensing the tape.

Cutting sections of the fixed blade 20 and the movable blade 30, which are in contact with each other, protrude inwardly to reduce a friction area of the blades, thereby exactly cutting the tape.

A lubricating oil supply part 40 is mounted on one side of the fixed blade 20 for supplying lubricating oil. The lubricating oil supply part 40 includes a lubricating oil storing member 41 being in contact with one side of the fixed blade 20, a sponge 43 soaked with lubricating oil and embedded in the lower portion of the lubricating oil storing member 41, and a number of lubricating oil supply holes 42 formed in the lubricating oil storing member 41 for supplying lubricating oil to the sponge 43.

As shown in FIGS. 4 and 5, it is possible that the lubricating oil supply part 40 has a groove 41*a* formed at the center of the fixed blade 20, the sponge 43 soaked with lubricating oil is embedded in the inside of the groove 41*a*, and an oiling hole 42*a* is formed in the groove 41*a*. Though the structure of the movable blade 30 is not shown in the drawings, the above structure may be applied to the movable blade 30.

Referring to the drawings, the use of the present invention will be described in detail as follows.

First, the tape cutting device according to the present invention is in the form of a cartridge and detachably assembled so as to be easily replaced and repaired. When the tape cutting device is mounted on the front surface of the roll tape cutter, the tape feed-out sensor 8 protruding from the front surface of the tape cutter is inserted into the sensor inserting hole 33 formed in the movable blade 30.

In the above arrangement, when the tape cutter is operated, the tape is fed out. When the tape feed-out sensor 8 senses it, a driving part 6 is operated. The driving part 6 has a pair of fixed protrusions 6*a* for lifting the movable blade 30 while operating in a state that the fixed protrusions 6*a* are fit into the horizontal hole 31 and the inclined hole 32.

That is, when the driving part 6 rises, the fixed protrusions 6*a* are ascended in the state where the fixed protrusions 6*a* are fit into the horizontal hole 31 and the inclined hole 32. At this time, the side of the horizontal hole 31 is first ascended, and then, the side of the inclined hole 32 is ascended, and thereby, the movable blade 30 is in contact with the fixed blade 20 in an inclined condition. Because an inclined angle is formed between the horizontal hole 31 and the inclined hole 32, the centers of the two blades are exactly met the moment the movable blade 30 is in contact with the fixed blade 20, so that the tape cutter can exactly cut the tape.

As described above, the movable blade 30 is moved smoothly because the rising movable blade 30 is moved upwardly according to the guide of the guide channel 12. Moreover, the movable blade 30 can exactly cut the tape even though an interval between the blades is narrow because the movable blade 30 is ascended maintaining a predetermined inclined angle, thereby preventing accidents.

At this time, because the cutting sections of the movable blade 30 and the fixed blade 20 protrude inwardly, the blades can exactly cut the tape without an adhesive part of the tape adhered to the blades. The movable blade 30 and the fixed blade 20 can prevent accidents because they are enclosed by the frame 10 so as not to be exposed to the outside. Additionally, because the lubricating oil storing member 41 covers the blades, users do not have a feeling of rejection to the blades in a visual aspect.

Lubricating oil soaked into the sponge 43 is coated on one side of the movable blade 30 or the fixed blade 20 to operate the blades smoothly and to prevent the adhesive of the tape being adhered onto the blades. When the lubricating oil soaked into the sponge 43 is consumed, other lubricating oil is supplied through the lubricating oil supply holes 42 or the oiling hole 42*a*. Therefore, the blades can operate exactly and safely, and the life of the blades can be extended.

As described above, the present invention can make the tape cutter compact because the tape feed-out sensor is inserted into the center of the movable blade, and cut the tape at a very short and exact length because the tape feed-out sensor is mounted near the cutting sections of the blades.

Furthermore, the present invention can isolate the cut tape easily because the cutting sections of the movable blade and the fixed blade protrude inwardly.

Additionally, the present invention can operate the blades smoothly to cut the tape because the lubricating oil is supplied continuously to the sides of the fixed blade and the movable blade.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A tape cutting device of an automatic roll tape cutter, which feeds out a roll tape mounted in the roll tape cutter by a predetermined length and cuts the tape automatically, the tape cutting device comprising:

a frame detachably assembled on the front surface of a case of the tape cutter, the frame having a slot formed therethrough and movable blade guide channels formed on both sides of the rear surface of the frame;

a fixed blade mounted on the upper portion of the rear surface of the frame having a cutting section;

a movable blade having a cutting section mounted on the lower portion of the rear surface of the frame in such a manner to permit said movable blade to move toward said fixed blade while remaining parallel with the fixed blade, the movable blade having a horizontal hole formed on one side of the lower end thereof, an inclined hole formed on the other side of the lower end thereof, and a tape read-out sensor inserting hole formed at the center thereof;

said cutting sections of said fixed blade and said movable blade adapted to contact each other upon movement of said movable blade toward said fixed blade whereby said tape is cut; and a lubricating oil supply part for supplying lubricating oil to sides of the fixed blade and the movable blade or a side of the fixed blade or the movable blade.

2. The tape cutting device according to claim 1, wherein cutting sections of the fixed blade and the movable blade protrude inwardly to reduce a friction area and exactly cut the tape.

3. The tape cutting device according to claim 1, wherein the lubricating oil supply part has a lubricating oil storing member being in contact with one side of the fixed blade and having a sponge soaked with lubricating oil on the lower portion thereof, and lubricating oil supply holes formed in the lubricating oil storing member for supplying lubricating oil to the sponge.

4. The tape cutting device according to claim 1, wherein the lubricating oil supply part has a groove formed in the fixed blade or the movable blade for allowing the sponge to be embedded therein and an oiling hole formed in the fixed blade or the movable blade for supplying lubricating oil to the sponge.

* * * * *